US012612740B2

(12) United States Patent
Daxberger et al.

(10) Patent No.: US 12,612,740 B2
(45) Date of Patent: Apr. 28, 2026

(54) METHOD AND MACHINE FOR TAMPING A TRACK

(71) Applicant: Plasser & Theurer Export von Bahnbaumaschinen Gesellschaft m.b.H., Vienna (AT)

(72) Inventors: Harald Daxberger, Linz (AT); Christian Koczwara, Gresten (AT); Samir Omerovic, Eidenberg (AT)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 515 days.

(21) Appl. No.: 18/280,002

(22) PCT Filed: Mar. 10, 2022

(86) PCT No.: PCT/EP2022/056127
§ 371 (c)(1),
(2) Date: Sep. 1, 2023

(87) PCT Pub. No.: WO2022/218614
PCT Pub. Date: Oct. 20, 2022

(65) Prior Publication Data

US 2024/0141596 A1 May 2, 2024

(30) Foreign Application Priority Data

Apr. 12, 2021 (AT) ..... A 50266/2021

(51) Int. Cl.
*E01B 27/17* (2006.01)
*E01B 27/16* (2006.01)

(52) U.S. Cl.
CPC ..... *E01B 27/17* (2013.01); *E01B 27/16* (2013.01); *E01B 2203/12* (2013.01)

(58) Field of Classification Search
CPC ..... E01B 27/16; E01B 2203/12; E01B 27/17; E01B 2203/127; E01B 2203/10; E01B 27/20; E01B 35/00
See application file for complete search history.

(56) References Cited

U.S. PATENT DOCUMENTS 3,807,311 A * 4/1974 Plasser ..... E01B 27/17 104/12
3,981,247 A 9/1976 Theurer
(Continued)

FOREIGN PATENT DOCUMENTS

AT 339358 B 10/1977
AT 350097 B 5/1979
(Continued)

OTHER PUBLICATIONS

International Search Report in PCT/EP2022/056127 dated Jun. 2, 2022.
(Continued)

*Primary Examiner* — Cheng Lin
(74) *Attorney, Agent, or Firm* — Collard & Roe, P.C.; William Collard

(57) ABSTRACT

The invention relates to a method for tamping sleepers of a track panel, supported in a ballast bed, by means of a tamping unit, comprising two tamping tools opposite one another which, during tamping of the respective sleeper, are lowered into the ballast bed with vibrations being applied, and are moved towards each other with a squeezing movement while the track panel is held in a raised position. In this, an evaluation device is used to monitor a squeezing speed of at least one tamping tool, with a current value of the squeezing speed being compared with a limit value when a predefined squeezing time or a predefined squeezing distance is reached, and with a notification signal indicating
(Continued)

whether the current value is above the limit value. This may indicate that a void located below the sleeper has not yet been sufficiently filled.

15 Claims, 3 Drawing Sheets

(56) References Cited

U.S. PATENT DOCUMENTS

| | | | | | |
|---|---|---|---|---|---|
| 4,010,692 | A * | 3/1977 | Goel | E01B 27/16 104/12 |
| 4,240,352 | A * | 12/1980 | Theurer | E01B 27/16 104/12 |
| 4,449,459 | A * | 5/1984 | Cicin-Sain | E01B 27/16 104/12 |
| 9,957,668 | B2 * | 5/2018 | Lichtberger | E01B 27/16 |
| 10,808,362 | B2 * | 10/2020 | Seyrlehner | B06B 1/162 |
| 10,914,040 | B2 * | 2/2021 | Hofstaetter | E01B 27/16 |
| 11,542,666 | B2 * | 1/2023 | Philipp | E01B 27/16 |
| 2020/0181850 | A1 * | 6/2020 | Kopf | E01B 35/08 |
| 2021/0395953 | A1 * | 12/2021 | Philipp | E01B 27/20 |

FOREIGN PATENT DOCUMENTS

| | | | | |
|---|---|---|---|---|
| AT | 515801 | A4 | 12/2015 | |
| AT | 515801 | B1 | 12/2015 | |
| AT | 519738 | A4 * | 10/2018 | E01B 27/16 |
| AT | 520056 | A1 | 12/2018 | |
| CN | 103079928 | A * | 5/2013 | E01B 37/00 |
| WO | 2014/127393 | A1 | 8/2014 | |
| WO | 2017/129215 | A1 | 8/2017 | |
| WO | WO-2019120829 | A1 * | 6/2019 | E01B 27/16 |
| WO | 2020/083596 | A1 | 4/2020 | |

OTHER PUBLICATIONS

Austrian Search Report in Austrian Application No. A 50266/2021 dated Feb. 21, 2022.

* cited by examiner

METHOD AND MACHINE FOR TAMPING A TRACK

CROSS REFERENCE TO RELATED APPLICATIONS

This application is the National Stage of PCT/EP2022/056127 filed on Mar. 10, 2022, which claims priority under 35 U.S.C. § 119 of Austrian Application No. A50266/2021, filed on Apr. 12, 2021, the disclosure of which is incorporated by reference. The international application under PCT article 21(2) was not published in English.

FIELD OF TECHNOLOGY

The invention relates to a method for tamping sleepers of a track panel, supported in a ballast bed, by means of a tamping unit, comprising two tamping tools opposite one another which, during tamping of the respective sleeper, are lowered into the ballast bed with vibrations being applied, and are moved towards each other with a squeezing movement while the track panel is held in a raised position. The invention further relates to a tamping machine for carrying out the method.

PRIOR ART

Railway lines with ballasted track require regular correction of the track position, with track tamping machines or turnout tamping machines or universal tamping machines usually being used. Such machines, movable on a track in a cyclic or continuous manner, usually comprise a measuring system, a lifting and lining unit, and a tamping unit. The track is lifted into a predefined position by means of the lifting and lining unit. To fix this new layer, track ballast is tamped and compacted from both sides below a respective sleeper of the track by means of tamping tools located on the tamping unit.

Various designs for tamping units for tamping sleepers of a track panel supported in a ballast bed are known. For example, AT 350 097 B discloses a tamping unit with hydraulic squeezing drives which are connected on the one hand to a rotating eccentric shaft for vibration generation and, on the other hand, to tiltable tamping tools. A tamping unit is known from AT 339 358 B which has hydraulic drives, serving, in a combined function, as squeezing drives and vibration generator.

AT 515 801 A4 describes a method for compacting a track ballast bed by means of a tamping unit; a quality figure for a hardness of the ballast bed is to be indicated. For this purpose, a squeezing force of a squeezing cylinder is recorded depending on a squeezing distance and a parameter is defined via an energy consumption derived therefrom. However, this parameter is not very meaningful because it does not take into account a non-negligible amount of energy that is lost in the system. Additionally, the total energy actually introduced into the ballast during a tamping process would also not allow a reliable assessment of a ballast bed condition.

In a method known from AT 520 056 A1, each vibration cycle caused by a vibration drive is analysed for at least one tamping tool. Specifically, during a vibration cycle, a progression of a force acting on the tamping tool over a distance the tamping tool covers is recorded. A continuous evaluation of these force-displacement progressions enables real-time detection of the condition of a ballast bed and whether a sufficient compaction is achieved.

PRESENTATION OF THE INVENTION

The object of the invention is to improve a method of the kind mentioned above in such a way that an optimum ballast filling of voids below the sleepers can be carried out in a simple manner. A further object of the invention is to indicate a corresponding tamping machine.

According to the invention, these objects are achieved by way of a method according to claim 1 and a machine according to claim 13. Dependent claims indicate advantageous embodiments of the invention.

In this, an evaluation device is used to monitor a squeezing speed of at least one tamping tool, with a current value of the squeezing speed being compared with a limit value when a predefined squeezing time or a predefined squeezing distance is reached, with a notification signal indicating whether the current value is above the limit value. During the filling of the voids below the sleepers, a counterforce caused by friction of the ballast acts on the tamping tools. This counterforce increases when the void is filled and the stiffness of the sleeper bed formed below the sleeper increases. As a result, the squeezing speed decreases while the squeezing pressure remains the same.

The present invention uses this effect to record the current filling condition. If the current value of the squeezing speed is still above the limit value after a predefined squeezing phase, a corresponding information output takes place by means of the notification signal. For example, an optical or acoustic notification signal is output. The current filling condition can also be indicated through maintaining a notification signal or through a changed notification signal when the status changes. In any case, the notification signal indicates whether, on the basis of the value comparison, a sufficient filling of the void located below the sleeper has already taken place or whether the filling is still insufficient. In the latter case, optimum filling is achieved with the following measures.

In a simple variant, the notification signal is fed to a display device to indicate to an operator an insufficient filling of a void below the current sleeper to be tamped. In this way, the operator is informed that the current tamping process should be continued and that further tamping processes may be necessary to achieve the optimum filling.

In an improved embodiment of the invention, the notification signal is fed to a control device of the tamping unit, with a longer squeezing time and/or a modified squeezing force being automatically specified, particularly by means of the control device. This requires no operator intervention to optimize the ballast filling.

If necessary, it is useful if the control device automatically triggers a further tamping process for the current sleeper to be tamped. This measure is particularly advantageous if an available squeezing distance of the tamping tool is not sufficient to achieve a desired filling condition.

An advantageous further development of the invention is characterized in that the frequency of the vibrations of the tamping tool is increased when the current value falls below the limit value. For this purpose, the current value is continuously compared with the limit value in order to record the achievement of an optimum filling condition. Only when this optimum filling condition is achieved do the vibrations transmitted from the tamping tool to the ballast lead to an increased temporary dynamic fluidization of the ballast due to the increased vibration frequency. This so-called ballast flowing causes the ballast grains to glide among each other with low friction. The ballast behaves fluid-like and vibrates independently into a higher layer density. During the filling phase, this effect is limited due to the lower vibration frequency. The friction maintained between the ballast grains facilitates the filling process because the tamping tools move larger interlocked ballast units. Flowing around the tamping tools is prevented.

For the comparison with the limit value, it is useful if the squeezing speed at the point in time of reaching the predefined squeezing time or the predefined squeezing distance is evaluated as the current value. In this variant, no high computing capacity of the evaluation device is required, as no modification of the recorded speed value is necessary.

In another variant, it may be advantageous that a value of the squeezing speed averaged over a range of the squeezing time or the squeezing distance is evaluated as the current value. This compensates for inaccuracies when recording the speed or irregularities during the squeezing process.

Another variant provides that the current value is determined as the result of a weighted time or distance integral. Less computing capacity is required if the current value is determined as a weighted sum of several measuring values of the squeezing speed. These measures also compensate for irregularities of the squeezing process, with certain phases of the squeezing process being emphasized by weighting them accordingly.

In an improvement of these variants, a weighting is predefined depending on a calculated or measured process variable of the tamping process. With this special weighting, an automated adjustment of the evaluation algorithms to changed tamping conditions is feasible.

Advantageously, a penetration work or a penetration force is determined as such a process variable during a lowering process of the tamping tool. Depending on this process variable, an adjusted weighting is subsequently derived for the formation of the current value of the squeezing speed.

A further improvement of the evaluation is achieved when a time progression of the squeezing speed or the squeezing distance is fed to a machine learning model as input data. For example, a neural network, a support vector machine, a decision tree, a regression analysis, or a Bayesian network is set up in the evaluation device. Further process variables, such as a lifting value of the track panel or a desired squeezing force, can also serve as input data for the model. The output of the model provides a current value that can be used to evaluate the filling condition.

The tamping machine according to the invention for carrying out one of the methods indicated comprises a lifting unit for lifting the track panel and a tamping unit for tamping lifted sleepers. In this, a sensor system is arranged to record a squeezing speed, with the sensor system being coupled with an evaluation device. An algorithm which compares a current value of the squeezing speed with a limit value is set up in the evaluation device. Additionally, the evaluation device is set up to output a notification signal, indicating whether the current value is above the limit value at the predefined time of comparison. The tamping machine designed in this way enables the voids formed below the lifted sleepers to be filled optimally in a simple manner.

In a simple further development, the evaluation device is coupled with a display device for displaying a notification. The display alerts an operator to an insufficient filling condition, whereupon necessary follow-up measures are initiated.

In a further improvement of the machine, the evaluation device is coupled with a control device of the tamping unit. As soon as the control device receives the information of an insufficient filling from the notification signal, measures for further filling of the voids are automatically initiated. For example, the squeezing time is extended or a further tamping process for the current sleeper to be tamped is carried out.

BRIEF DESCRIPTION OF THE DRAWINGS

In the following, the invention is explained by way of example with reference to the accompanying figures. The following figures show in schematic illustrations.

DESCRIPTION OF THE EMBODIMENTS

Figure 1:
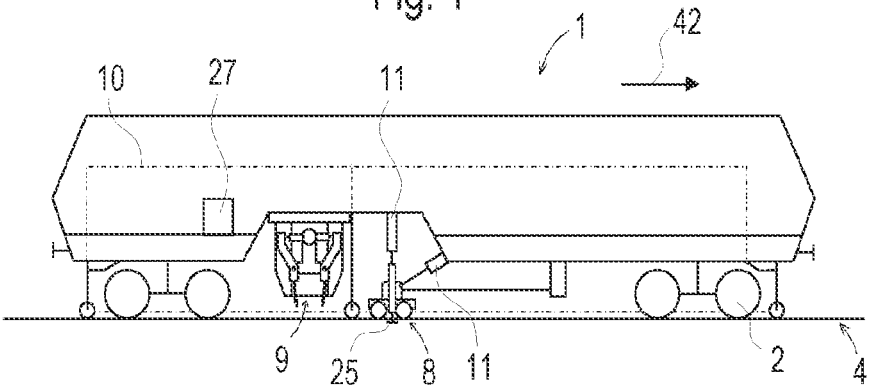
FIG. 1 Tamping machine

The tamping machine 1 shown in FIG. 1 is movable on rails 3 of a track 4 by means of rail-based running gears 2. Sleepers 6 supported in a ballast bed 5 form a track panel 7 together with the rails 3 fixed thereon. For carrying out the present method, the tamping machine 1 comprises a lifting unit 8 and a tamping unit 9. Additionally, a measuring system 10 is arranged for a correction of the track position. The units 8, 9 are adjustable in relation to a machine frame 12 via actuating drives 11. Advantageously, the lifting unit 8 is also provided for lateral lining of the track panel 7.

Figure 2:
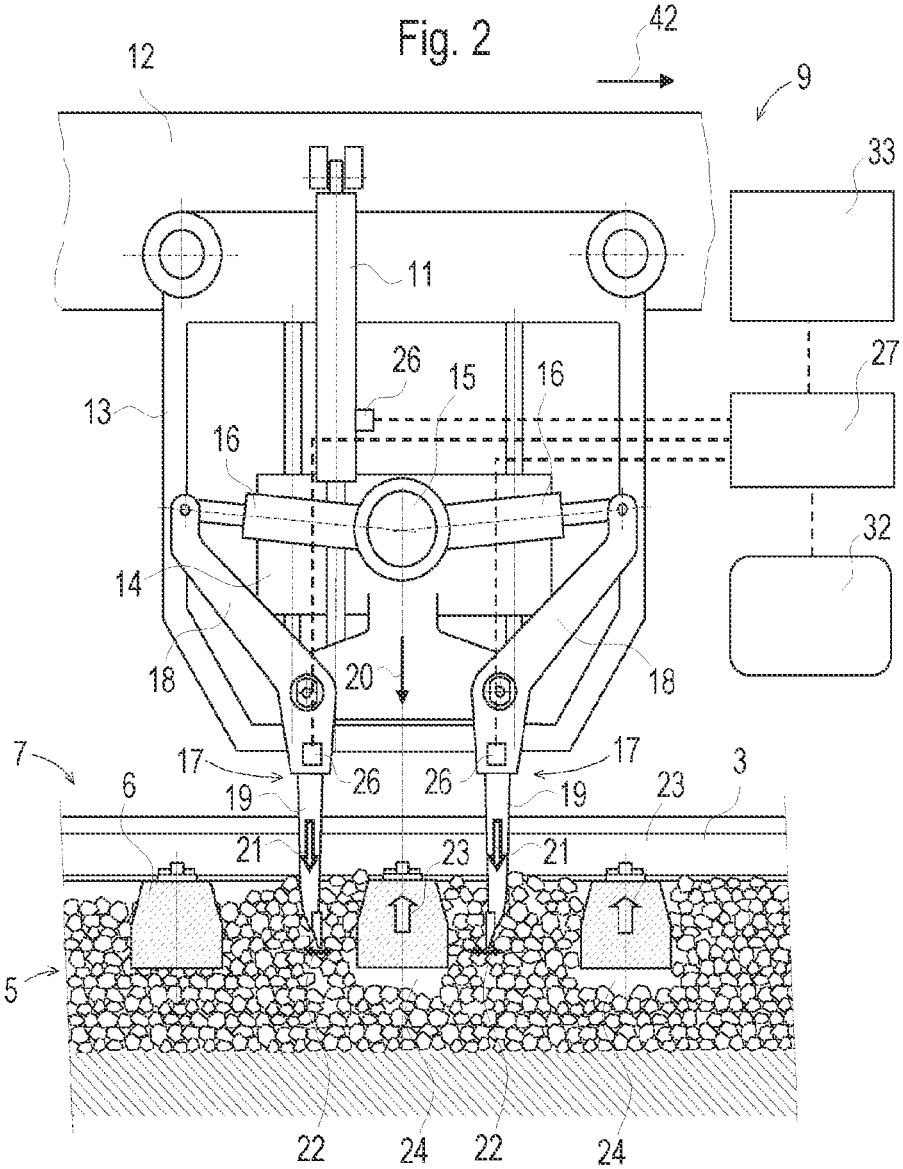
FIG. 2 Tamping unit during a lowering process

The tamping unit 9 and a treated section of the track 4 are shown in FIG. 2. A tamping tool carrier 14 is guided vertically in a tamping unit frame 13. A driven eccentric shaft is arranged on the tamping tool carrier 14 as a vibration drive 15. Two squeezing drives 16 are linked to the eccentric shaft. The rotation of the eccentric shaft causes the squeezing drives 16 to vibrate, with the respective eccentricity determining the vibration amplitude.

On the tamping tool carrier 14, tamping tools 17 are mounted opposite one another with respect to a sleeper 6 to be tamped. The respective tamping tool 17 comprises a tamping lever 18, the upper lever arm of which is connected to the associated actuating drive 16. A tamping tine 19, which penetrates the ballast bed 5 in the course of a tamping process, is arranged on the lower lever arm.

FIG. 2 shows the tamping unit 9 during a lowering movement 20 of the tamping tools 17, with the tamping tines 19 exerting a penetration force 21 on the ballast bed 5. During this process, the vibration drive 15 is active, so that vibrations 22 are applied to the respective tamping tine 19 via the associated tamping lever 18 and the blocked squeezing drive 16. The treated section of the track panel 7 is lifted into a predefined target position by means of the lifting unit 8 with a lifting force 23. In the process, voids 24 form below the sleepers 6 still to be tamped, which are to be filled with ballast during a tamping process. Roller clamps 25 of the lifting unit 8 hold the treated track panel 7 in position until the end of a respective tamping process.

A sensor 26 for recording a squeezing speed v is arranged at least on one tamping tool 17. This sensor system 26 is coupled with an evaluation device 27 in order to compare a current value 28 of the squeezing speed v with a stored limit value (threshold value) 29. This value comparison takes place continuously or at least at a certain point in time after the start of a squeezing movement 30. In any case, the result of that value comparison, which is carried out when reaching a predefined squeezing time $t_1$ or a predefined squeezing distance s, is subsequently relevant. For this purpose, a corresponding default value of the squeezing time t and/or the squeezing distance s is stored in the evaluation device 27. When this default value is reached, the squeezing movement is usually not yet finished. The total planned squeezing time or the total planned squeezing distance is greater than the default value relevant for the value comparison.

If the relevant value comparison shows that the current value 28 of the squeezing speed v is still above the limit value 29, a corresponding notification signal 31 is output by means of the evaluation device 27. This indicates that the void 24 of the currently tamped sleeper 6 has not yet been sufficiently filled. An operator receives the corresponding information via a display device 32 that receives the notification signal 31. In this way, the operator is able to initiate measures for optimizing the filling of the void 24.

The evaluation device 27 is coupled with a control device 33 of the tamping unit 9 for the automated implementation of corresponding measures. First, the notification signal 31 causes the squeezing movement to continue by means of the control device 33 through an adjusted actuation of the squeezing drives 16. It is checked continuously whether the current value 28 of the squeezing speed v reaches the limit value 29 after all. The maximum possible squeezing distance limits this measure. Additionally, a reserve is necessary so that the ballast pushed below the sleeper 6 during filling can be finally compacted. If necessary, the same sleeper 6 is tamped again as a further measure to ensure the optimum filling of the void 24. This process is in turn checked by comparing the current value 28 of the squeezing speed v with the limit value 29.

Figure 3:
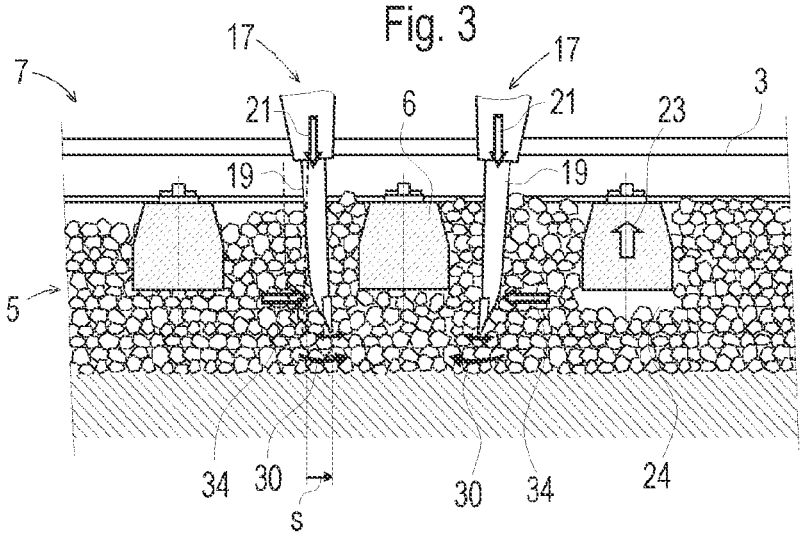
FIG. 3 Tamping tools during the filling of a void

Shortly before the tamping tines 19 have reached the predefined penetration depth, the squeezing movement 30 begins by a corresponding activation of the squeezing drives 16. First, the squeezing process causes the void 24 below the sleeper 6 to be filled, as shown in FIG. 3. In the process, the tamping tines 19 exert a constant squeezing force 34 on the ballast grains because a constant pressure is applied to the squeezing drives 16, designed as hydraulic cylinders.

During the filling of the void 24, vibrations 22 remain applied to the tamping tools 17, with the vibration frequency being advantageously lower compared to the frequency during penetration into the ballast bed 5. In this way, the ballast grains remain mobile. The lower frequency prevents excessive fluidization of the ballast grains so that no lateral drifting of the ballast grains occurs.

The start of the squeezing movement 30 is recorded in the evaluation device 27 in order to compare the current value 28 of the squeezing speed v with the stored limit value 29 when the predefined squeezing time $t_1$ is reached. The limit value 29 is determined in advance through theoretical analyses, through a simulation, or through a test and stored in the evaluation device 27.

Figure 6:
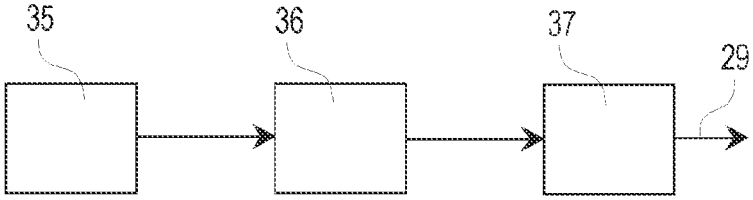
FIG. 6 Determination of the limit value

One possibility to determine the limit value 29 through a test is to lift the track panel 7 to the desired lifting value before the start of the actual tamping process. In a first step 35, the track panel 7 is lifted, as shown in FIG. 6. During the squeezing process, the squeezing speed v and, if necessary, the squeezing force 34 are measured in a second step 36. Additionally, in a third step 37, a measurement of the lifting force 23 is used to determine the point in time $t_0$ from which the ballast pushes the sleeper 6 upwards due to the complete filling of the void 24. At this point in time $t_0$, the lifting force 23 decreases and the squeezing speed v is reduced. The limit value 29 for recognizing whether the filling process is completed corresponds in this example to the speed measured when filling is achieved v.

By continuously comparing the current value 28 of the squeezing speed v with the limit value 29, the achievement of the optimum filling of the void 24 is recognized in each squeezing process. Advantageously, the frequency of the vibrations 22 of the tamping tools 17 is increased from this point onwards. The increased dynamic excitation increases the mobility of the ballast grains, which transition into a denser structure as a result. In this way, an optimum compaction of the ballast pushed below the sleeper 6 is achieved in the final phase of the squeezing process. The changeover from filling frequency to compaction frequency can also take place only distance-dependently or time-dependently. A corresponding threshold value is determined empirically in advance by measuring the lifting force 23 as described above.

In a further development of the invention, the limit value 29 and/or the point in time $t_1$ for carrying out the comparison with the current value 28 of the squeezing speed v is determined depending on other calculated or measured process variables. One such process variable is, for example, the penetration force 21 or the penetration work during the lowering of the tamping tines 19 into the ballast bed 5. The lifting of the track panel 7 by means of the lifting unit 8 and the desired squeezing force 34 can also serve as process variables for influencing the limit value 29 or the time of comparison $t_1$.

Additionally, it can be useful to determine an average speed as the current value 28 of the squeezing speed v. The squeezing speed v is recorded from the beginning of a squeezing process and an average value is continuously calculated. For example, the average speed can be determined by a weighted time or distance integral or by a weighted sum of several speed measuring values. The weighting can be time- or distance-dependent and can be defined depending on the process variables mentioned above. If the current value 28 determined in this way is above the limit value 29, an insufficient filling is detected.

Figure 4:
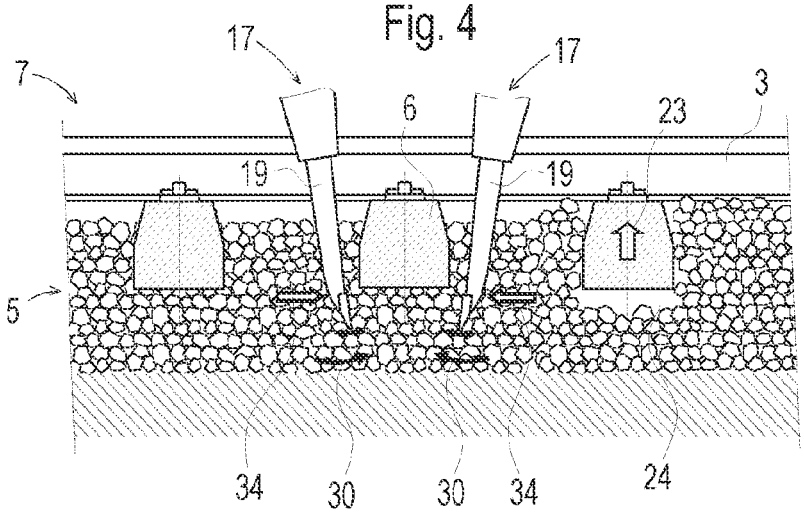
FIG. 4 Tamping tools during the compaction of the sleeper bed

A final compaction process 38 of the filled ballast is shown in FIG. 4. This process only occurs when the upstream filling process 39 has been completed. Since the resistance of the ballast during filling is lower than in the already filled condition, at a constant squeezing force 34 the squeezing movement 30 during filling takes place at a higher speed v than during the final compaction of the filled ballast.

Figure 5:
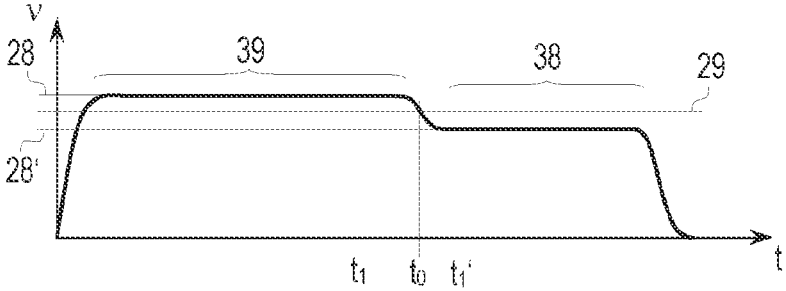
FIG. 5 Diagram of the squeezing speed over time

The corresponding speed progression is shown in FIG. 5. At the point in time $t_0$, when the void 24 below the sleeper 6 is completely filled, the limit value 29 is determined in advance. In a first example of a squeezing process, a comparison of the current value 28 of the squeezing speed v with the limit value 29 is carried out for a predefined squeezing time $t_1$.

This first example shows that the current value 28 is still above the limit value 29. This is associated with the information that the filling process 39 has not yet been completed. In the second example, the comparison is made at a later point in time $t_1'$ because a longer squeezing time is predefined. Here the current value 28 has already fallen below the limit value 29. The comparison provides the information that the filling process 39 is completed.

The speed v is measured or estimated, for example, by measuring the squeezing distance at the squeezing cylinder 16, by measuring a swivel angle of the tamping lever 18, or by measuring a volume flow of a squeezing cylinder 16 or several squeezing cylinders 16. In a further development of the invention, the progression of the measured or estimated squeezing speed v is used as input variables for a machine learning model. For example, a neural network, a support vector machine, a decision tree, a regression analysis algorithm, or a Bayesian network is set up in the evaluation device 27.

Figure 7:
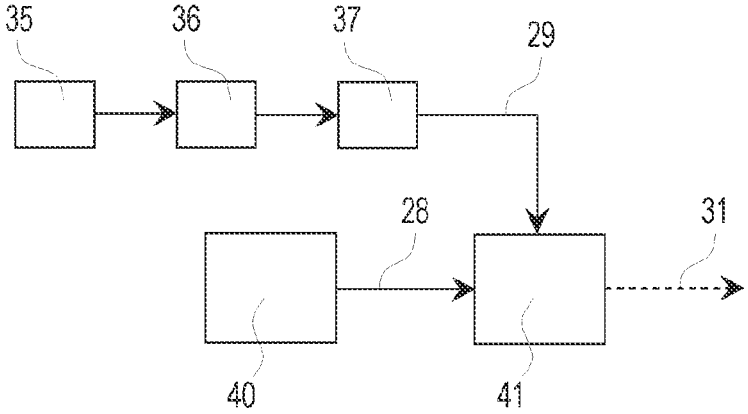
FIG. 7 Determination of the limit value and evaluation of the measured squeezing speed

FIG. 7 shows a simple evaluation by means of the evaluation device 27. As described above, the limit value 29 is determined and stored in advance. During each squeezing process 40, the squeezing speed vis recorded. In a comparison process 41, the current value 28 of the squeezing speed v is compared with the stored limit value 29. From this, an automated decision is made as to whether the current filling process 39 is completed or not. In the event of insufficient filling, a corresponding notification signal 31 is output.

This ensures that each sleeper 6 is optimally tamped. Only when the void 24 below the respective sleeper 6 has been completely filled and the compaction of the filled ballast has been completed does the tamping of the next sleeper 6 take place in the working direction 42. This process is advantageously automated in that the control device 33 reports to a machine control that a tamping process has been completed. As a result, the machine 1 or a so-called satellite is moved forward by one sleeper spacing or, in the case of a multiple-sleeper tamping unit 9, by several sleeper spacings.

If necessary, the tamping process is interrupted after a predefined number of tamping processes or in the event of an obvious change in the conditions in order to determine the limit value 29 anew. This can be useful, for example, if a new ballast layer transitions into an old ballast layer or if the type of sleepers 6 changes. Otherwise, common changes in track conditions are compensated by the described weightings depending on determined process variables.

The invention claimed is:

1. A method for tamping sleepers of a track panel, supported in a ballast bed, by means of a tamping unit, comprising two tamping tools opposite one another which, during tamping of the respective sleeper, are lowered into the ballast bed with vibrations being applied, and are moved towards each other with a squeezing movement while the track panel is held in a raised position, wherein an evaluation device is used to monitor a squeezing speed of at least one tamping tool, that a current value of the squeezing speed is compared with a limit value when a predefined squeezing time or a predefined squeezing distance(s) is reached, and that a notification signal indicates whether the current value is above the limit value.

2. The method according to claim 1, wherein the notification signal is fed to a display device to indicate to an operator an insufficient filling of a void below the current sleeper to be tamped.

3. The method according to claim 1, wherein the notification signal is fed to a control device of the tamping unit, and that a longer squeezing time and/or a modified squeezing force is automatically specified, particularly by means of the control device.

4. The method according to claim 3, wherein the control device automatically triggers a further tamping process for the current sleeper to be tamped.

5. The method according to claim 1, wherein the frequency of the vibrations of the tamping tool is increased when the current value falls below the limit value.

6. The method according to claim 1, wherein the squeezing speed at the point in time of reaching the predefined squeezing time or the predefined squeezing distance(s) is evaluated as the current value.

7. The method according to claim 1, wherein a value of the squeezing speed averaged over a range of the squeezing time or the squeezing distance(s) is evaluated as the current value.

8. The method according to claim 1, wherein the current value is determined as the result of a weighted time or distance integral.

9. The method according to claim 8, wherein a weighting is predefined depending on a calculated or measured process variable of the tamping process.

10. The method according to claim 9, wherein a penetration work or a penetration force is recorded as a process variable during the lowering of the tamping tools.

11. The method according to claim 1, wherein the current value is determined as a weighted sum of several measuring values of the squeezing speed.

12. The method according to claim 1, wherein a time progression of the squeezing speed or the squeezing distance (s) is fed to a machine learning model as input data.

13. A tamping machine for carrying out a method according to claim 1, further, comprising a lifting unit for lifting the track panel and the tamping unit for tamping lifted sleepers, wherein a sensor system is arranged to record the squeezing speed, and that the sensor system is coupled with the evaluation device, which is set up for comparing the current value of the squeezing speed with the limit value and for outputting the notification signal, indicating whether the current value is above the limit value.

14. The tamping machine according to claim 13, wherein the evaluation device is coupled with a display device for displaying a notification.

15. The tamping machine according to claim 13, wherein the evaluation device is coupled with a control device of the tamping unit.

* * * * *